United States Patent [19]

Kraay

[11] Patent Number: 5,056,594

[45] Date of Patent: Oct. 15, 1991

[54] WAVY HEAT TRANSFER SURFACE

[75] Inventor: Michael L. Kraay, Dakota, Minn.

[73] Assignee: American Standard Inc., New York, N.Y.

[21] Appl. No.: 563,163

[22] Filed: Aug. 3, 1990

[51] Int. Cl.[5] ..... F28F 1/30

[52] U.S. Cl. ..... 165/151; 165/181

[58] Field of Search ..... 165/151, 181, 182

[56] References Cited

U.S. PATENT DOCUMENTS

| | | | |
|---|---|---|---|
| 1,416,570 | 5/1922 | Modine | 165/151 |
| 3,397,741 | 8/1968 | Gunter | 165/152 |
| 3,796,258 | 3/1974 | Malhotra et al. | 165/151 |
| 3,902,551 | 9/1975 | Lim et al. | 165/111 |
| 4,614,230 | 9/1986 | Sakuma et al. | 165/151 |
| 4,691,768 | 9/1987 | Obosu | 165/151 |
| 4,787,442 | 11/1988 | Esformes | 165/151 |
| 4,817,709 | 4/1989 | Esformes | 165/151 |
| 4,860,822 | 8/1989 | Sacks | 165/151 |

FOREIGN PATENT DOCUMENTS

| | | | |
|---|---|---|---|
| 0325553 | 10/1989 | European Pat. Off. . | |
| 60-223995 | 11/1985 | Japan | 165/151 |

*Primary Examiner*—Allen J. Flanigan

*Attorney, Agent, or Firm*—William J. Beres; William O'Driscoll

[57] ABSTRACT

A heat exchanger surface for a refrigeration system comprising a wavy heat exchange surface formed with a series of peaks and troughs extending over the wavy surface in a direction substantially perpendicular to the direction of airflow. The wavy surface includes a plurality of holes aligned in first and second rows parallel to the peaks and troughs, where the aligned holes within each row are separated by a smooth area. The wavy surface includes louvers for enhancing heat transfer. The louvers are located between the peaks and troughs on the wavy surface, but are not located in the smooth areas between the aligned holes of the first and second holes.

32 Claims, 1 Drawing Sheet

WAVY HEAT TRANSFER SURFACE

TECHNICAL INFORMATION

The present invention is directed to heat exchangers for refrigeration systems, and more particularly, to improvements in the heat transfer rate of wavy surfaces in a heat exchanger.

BACKGROUND OF THE INVENTION

Heat transfer enhancement by louvering or slitting plate fin surfaces in heat exchangers has long been recognized as offering significant improvements in plate finned coil performance. The form and arrangement of the louvers are unique to the type of plate fin surface used in the particular heat exchanger since the airflow characteristics vary with the type of plate fin surface. The airflow characteristics of a surface depend upon whether the surface is flat, corrugated or wavy, and depend upon the arrangement of the heat transfer tubes. Most surfaces known today increase the heat transfer performance of the coil when the heat transfer surface is dry, such as when the coil is used as a refrigerant condenser. However, when the surfaces are wet, such as when the coil is used as an evaporator, the heat transfer performance is not improved by louvering or slitting the plate fin surface. Additionally, many previous plate fin surfaces suffer from high airside pressure drop, which means that more power is required to move air through the coil.

U.S. Pat. No. 4,860,822 discloses sinusoidal plate fin surfaces having lances located at each peak and trough in the area between the heat transfer tubes. Similarly, European patent application EP 0 325 553 Al discloses sinusoidal plate fin surfaces having apertures located at each peak and trough in the area between the heat transfer tubes. U.S. Pat. Nos. 4,817,709 and 4,787,442 clearly show "delta wings" and "ramps" located after each peak and trough in the area between the heat transfer tubes. U.S. Pat. Nos. 4,614,230 and 3,397,741 are examples of patents which show a slight gap between the heat transfer tubes but still disclose louvers located in the areas between the heat transfer tubes. Neither of these last mentioned patents are directed to wavy plate fin surfaces, which means that their airflow characteristics will vary considerably from the airflow characteristics of a wavy plate fin surface.

SUMMARY OF THE INVENTION

It is an object of the invention to solve the problems of the prior art plate fin heat exchangers.

It is a further object and advantage of the present invention to provide a wavy plate fin surface which increases the heat transfer performance of both wet and dry surfaces.

It is a further object and advantage of the present invention to provide a wavy plate fin surface which minimizes air side pressure drop.

Is is an object and advantage of the present invention to provide a single plate fin surface for use in either the condenser or the evaporator.

The present invention provides a heat exchanger for a refrigeration system comprising a wavy heat exchange surface formed with a series of peaks and troughs extending over the wavy surface in a direction substantially perpendicular to the direction of airflow. The wavy surface includes a plurality of holes aligned in first and second rows parallel to the peaks and troughs, where the aligned holes within each row are separated by a smooth area. The wavy surface includes louvers for enhancing heat transfer. The louvers are located between the peaks and troughs on the wavy surface, but are not located in the smooth areas between the aligned holes of the first and second holes.

The present invention further provides a plate fin for use in a heat exchanger comprising a plate fin surface having a predetermined thickness. The plate fin surface includes a series of alternating parallel peaks and troughs. The plate fin surface includes apertures adapted to engage heat transfer tubes when such tubes are passed through the apertures. The apertures are aligned in rows parallel to the direction of the peaks and troughs and the apertures in each row are separated by a smooth area of the plate fin surface. The plate fin surface also includes louvers for enhancing the heat transfer rate of the plate fin surface, where the louvers are located between the parallel peaks and troughs on the plate fin surface but are not located in the smooth area separating the aligned apertures.

The present invention also provides a method of forming a plate fin surface for a heat exchanger comprising the steps of forming a surface into a wavy series of alternating parallel peaks and troughs, forming rows of apertures in the plate fin surface parallel to the peaks and troughs, and selecting areas for enhancement upon the surface between adjacent peaks and troughs such that the areas are not located between the apertures forming the rows of apertures.

The present invention further provides a heat exchanger for a refrigeration system. The heat exchanger includes first and second rows of heat transfer tubes which are staggered with respect to each other when viewed from a direction of air flow, and a series of wavy plate fin surfaces which are substantially parallel to the direction of air flow. Each wavy plate fin surface includes at least first and second rows of apertures which are sized and located to receive the heat transfer tubes. The apertures within each of the first rows and each of the second rows are separated by smooth areas. Each wavy plate fin surface is formed of a series of a alternating peak and trough extending over the wavy plate fin surface in a direction substantially perpendicular to the direction of air flow. Each of the wavy surfaces includes louvers for enhancing heat transfer where the louvers are located between the peaks and troughs on the wavy surface, but are not located in the smooth areas between the aligned holes.

DETAILED DESCRIPTION OF THE INVENTION

Figure 1:
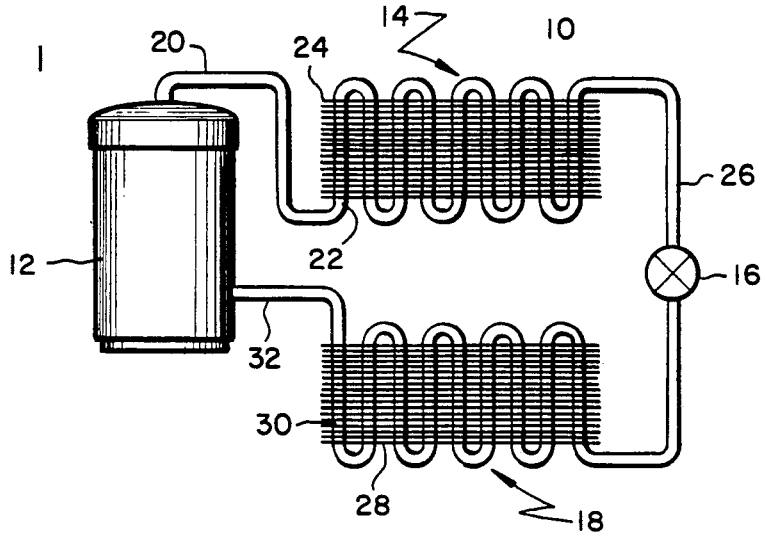
FIG. 1 is a block diagram of a refrigeration system incorporating the present invention.

FIG. 1 shows a refrigeration system 10 which includes a compressor 12, a condenser 14, an expansion valve 16 and an evaporator 18. The compressor 12 compresses a refrigerant vapor and passes the compressed vapor to the condenser 14 by means of a hot gas line 20. The compressed refrigerant vapor enters the coils 22 of the condenser 14 and dissipates its heat through the coil walls into a plurality of wavy plate fin surfaces 24. The heat from the refrigerant vapor is transferred from the coil walls and the plate fin surfaces 24 to a cooling medium such as air passing through the condenser 14. The compressed refrigerant vapor condenses to a liquid and passes along a refrigerant line 26 through the expansion valve 16 to the evaporator 18. The expansion valve 16 maintains the pressure created by the compressor 12, and controls the amount of liquid refrigerant passed to the evaporator 18. A medium to be cooled such as air passes over a plurality of wavy plate fin surfaces 28 and transfers heat to those surfaces 28. The heat is then conducted from the wavy plate fin surfaces 28 into the evaporator coils 30 where the liquid refrigerant vaporizes in absorbing the heat. The vaporized refrigerant is then passed back to the compressor 12 by a suction line 32 connecting the evaporator 18 to the compressor 12.

Refrigerants contemplated for use in the refrigerant system 10 include R11, R22, R123, R134a as well as water and other common refrigerants used in multiple ton refrigeration systems.

Figure 2:
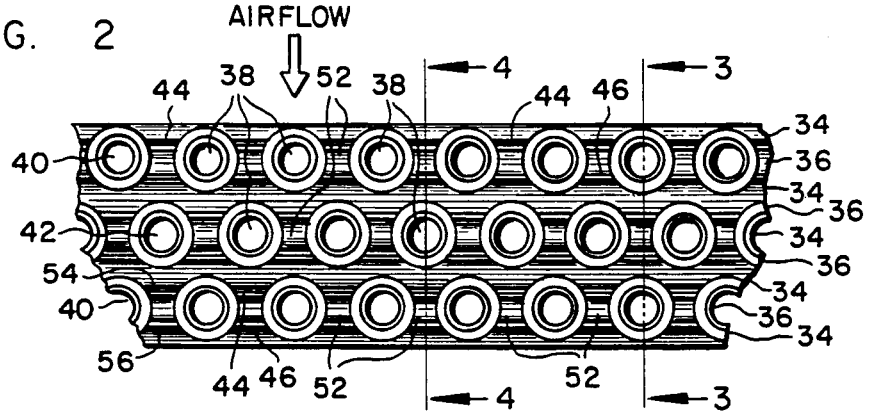
FIG. 2 is a top perspective view of a wavy plate fin incorporating the present invention.
Figure 3:
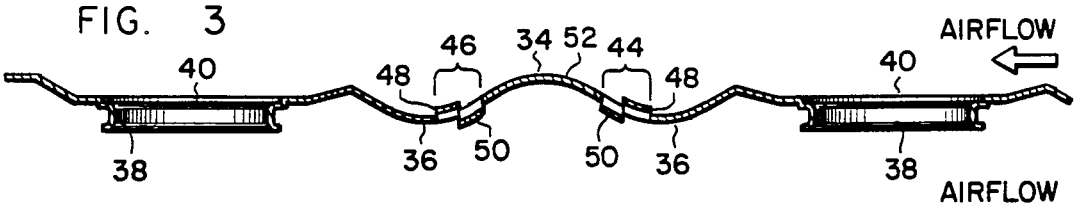
FIG. 3 is a cross-sectional view of the plate fin of the present invention taken along lines 3—3 of FIG. 2.
Figure 4:
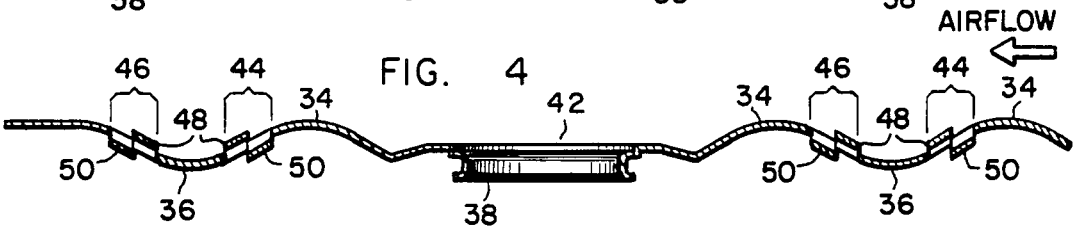
FIG. 4 is a cross-sectional view of the plate fin of the present invention taken along lines 4—4 of FIG. 2.
Figure 5:
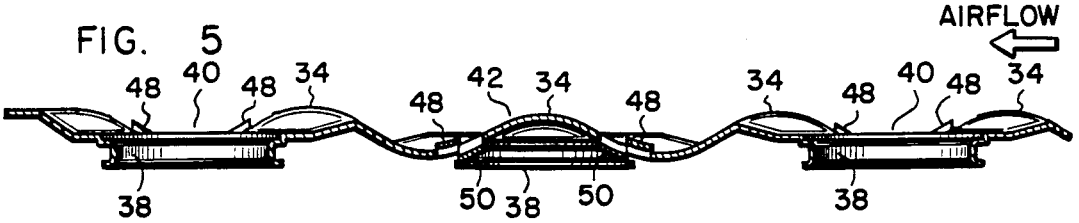
FIG. 5 is a perspective cross-sectional view of the plate fin of the present invention taken along lines 3—3 of FIG. 2.

FIG. 2 shows a single plate fin 24, 28 incorporating the present invention for use in either the condenser 14 or the evaporator 18 As can be seen from FIGS. 3, 4 and 5, the plate fin 24, 28 is a wavy surface formed of alternating parallel peaks 34 and troughs 36. The surface 24, 28 includes a plurality of apertures 38 adapted to engage the heat transfer tubes 22 and 30 of the condenser 14 and evaporator 18. The apertures 38 are arranged in alternating staggered rows 40 and 42 where the rows 40 and 42 are parallel to each other and to the peaks 34 and troughs 36 on the surface 24. Each of the peaks 34, troughs 36, and rows 40 and 42 are perpendicular to the direction of airflow as shown by arrows in FIGS. 2–5.

As shown in FIGS. 3–5, the rows 40 are aligned with every third trough 36, while the rows 42 are aligned with every third peak 34. The arrangement is such that a peak 34 aligned with a row 42 is not adjacent to a trough 36 having a row 40. FIG. 3 shows a cross-sectional profile where the rows 40 have apertures 38 aligned with the troughs 36. FIG. 4 shows a cross-sectional profile of the surface 24 where the apertures 38 of row 42 are aligned with the peak 34. FIG. 5 shows a combination of FIGS. 3 and 4 showing the super imposed alignment of the rows 42 and troughs 36 upon the rows 42 and peaks 34.

Enhancements to the surface 24, 28 are accomplished by slitting and raising, or lowering, louvers 44 and 46 from the surface 24, 28 a distance at most four times the thickness of the surface 24, 28. In the preferred embodiment the louvers 44 and 46 are raised or lowered a distance from the surface 24, 28 approximately 3.6 times the thickness of the surface 24, 28. However, some test data indicates that the louvers 44 and 46 should not be raised or lowered a distance from the surface 24, 28 which is more than three times the thickness of the surface 24, 28. As of the time of filing of this application, the preferred embodiment is a ratio of raising or lowering the louvers 44, 46 a distance from the surface 24, 28 approximately 3.6 times the thickness of the surface 24, 28.

In the preferred embodiment the louvers 44 and 46 remain connected on two sides with open sides facing the direction of airflow. The louvers 44 and 46 are located between the peaks 34 and troughs 36 on the surface 24, 28. In the preferred embodiment each louver 44 and 46 includes a first portion 48 raised from the surface 24, 28 and a second portion 50 lowered from the surface 24, 28. Whichever portion 48 or 50 is closest the nearest peak 34 or trough 36 projects from the surface 24, 28 in a direction opposite to that of the nearest peak 34 or trough 36. Additionally, as shown in FIG. 3, each pair of louvers 44 and 46 are mirror images of each other. The louvers 46 and 44 are arranged in alternating rows 54, 56 which are perpendicular to the direction of airflow and parallel to the peaks 34 and troughs 36. The louvers 44 and 46 are mirror images of each and are located on each side of a peak 34 or a trough 36.

It is critically important to the invention that the louvers 44, 46 not be located in the unenhanced areas 52 directly between the apertures 38 in either of the rows 40 or 42. This arrangement of the louvers 46 and 48 increases the heat transfer performance of both wet and dry surfaces 24 while minimizing air side pressure drop.

Although the present invention has been described in connection with the preferred embodiment above, it is apparent that many alterations and modifications are present without departing from the present invention as long as the location of louver enhancement remain substantially as described above. It is intended that all such alterations and modifications be considered within the scope and spirit of the invention as defined in the following claims.

What is claimed and desired to be secured by Letters Patent of the United States is:

1. A heat exchange surface for use in a refrigeration system comprising:

a wavy heat exchange surface formed with a series of alternating peaks and troughs extending over the wavy surfaces in a direction substantially perpendicular to a direction of airflow;

the wavy surface including a plurality of holes aligned in first and second rows parallel to the peaks and troughs, where the first and second rows of aligned holes are staggered with respect to each other when viewed from the direction of airflow, where the first rows of aligned holes are located in alignment with every third peak of the wavy surface, and the second rows of aligned holes are located in alignment with every third trough of the wavy surface such that the peaks aligned with the first rows of aligned holes are not immediately adjacent the troughs aligned with the second rows of aligned holes and where the aligned holes within each row are separated by a smooth area in alignment with one of the third peaks or the third troughs; and the wavy surface including means for enhancing heat transfer where the enhancement means are located between the peaks and troughs on the wavy surface, but are not located in the smooth areas between the aligned holes of the first and second rows.

2. The heat exchanger of claim 1 wherein the enhancement means includes louvers.

3. The heat exchanger of claim 2 wherein each louver has an upwardly directed element and a downwardly directed element.

4. The heat exchanger of claim 3 where each louver is paired with a second louver formed in its mirror image.

5. The heat exchanger of claim 4 wherein the louver elements of each louver closest to the nearest peak or trough extend from the wavy surface in a direction opposite the nearest peak or trough.

6. The heat exchanger of claim 5 wherein the amount of protrusion of each louver from the wavy surface is in the range of zero to four times the thickness of the wavy surface.

7. The heat exchanger of claim 1 wherein the enhancement means includes louvers.

8. The heat exchanger of claim 7 wherein the amount of enhancement of each louver from the wavy surface is not greater than three times the thickness of the surface.

9. The heat exchanger of claim 8 wherein the louvers remain attached to the wavy surface on two sides of the louver.

10. The heat exchanger of claim 7 wherein the amount of protrusion of each louver from the wavy surface is not greater than four times the thickness of the surface.

11. The heat exchanger of claim 10 wherein the amount protrusion of each louver from the wavy surface is approximately 3.6 times the thickness of the surface.

12. A plate fin for use in a heat exchanger of a refrigeration system comprising:

a plate fin surface having a predetermined thickness, the plate fin surface including a series of alternating parallel peaks and troughs, the plate surface including apertures adapted to engage heat transfer tubes when such tubes are passed through the apertures, where the apertures are alternately aligned with every third peak or every third trough in rows parallel to the direction of the peaks and troughs, and the apertures in each row are separated by a smooth area of the plate fin surface where the smooth area is aligned with the respective peak or trough; and means for enhancing the heat transfer rate of the plate fin surface wherein the enhancement means are located between the parallel peaks and troughs on the plate fin surface but are not located in the smooth area separating the aligned apertures.

13. The plate fin of claim 12 wherein the enhancement means includes louvers arranged in pairs on each side of a peak or trough.

14. The plate fin of claim 13 wherein each louver includes the first element extending from the plate fin surface in the first direction, and a second element extending from the plate fin surface in a second direction.

15. The plate fin of claim 14 wherein the first and second directions are opposite of each other.

16. The plate fin of claim 12 wherein the enhancement means extends from the surface a distance which is at most four times the thickness of the plate fin surface.

17. The plate fin of claim 16 wherein the enhancement means extends from the plate fin surface approximately 3.6 times the thickness of the plate fin surface.

18. The plate fin of claim 16 wherein the enhancement means extends from the plate fin surface a distance which is at most three times the thickness of the plate fin surface.

19. A method of forming a plate fin surface for a heat exchanger comprising the steps of:

forming a surface into a wavy series of parallel peaks and troughs;

forming first and second staggered rows of apertures in the plate fin surface parallel to and in alignment with the peaks and troughs such that the first rows of apertures are aligned with every third peak and the second rows of apertures are aligned with every third trough; and selecting areas for enhancement upon the surface between adjacent peaks and troughs such that the enhancement areas are not located in smooth areas which are aligned with a peak or trough and which are located between the apertures forming the rows of apertures.

20. The method of claim 19 including the further step of enhancing the selected areas by forming louvers which extend from the plate fin surface a distance at most four times the thickness of the plate fin surface.

21. The method of claim 20 including the further step of enhancing the selected areas a distance from the plate fin surface which is approximately 3.6 times the thickness of the plate fin surface.

22. The method of claim 19 including the further step of enhancing the selected areas by forming louvers which extend from the plate fin surface a distance at most three times the thickness of the plate fin surface.

23. A heat exchanger for a refrigeration system comprising:

first and second rows of heat transfer tubes which are staggered with respect to each other when viewed from a direction of air flow;

a series of wavy plate fin surfaces which are substantially parallel to the direction of air flow where each wavy plate fin surface includes at least first and second rows of apertures which are sized and located to receive the heat transfer tubes and where the apertures within each of the first rows and each of the second rows are separated by smooth areas;

each wavy late fin surface formed of a series of alternating peaks and troughs extending over the wavy plate fin surface in a direction substantially perpendicular to the direction of air flow where the first and second rows of aligned holes are staggered with respect to each other when viewed from the direction of airflow and wherein the first rows of aligned holes are located in alignment with every third peak of the wavy surface, and the second rows of aligned holes are locate din alignment with every third trough of the wavy surface such that the peaks aligned with the first rows of aligned holes are not immediately adjacent the troughs aligned with the second rows of aligned holes; and each of the wavy surfaces including means for enhancing heat transfer where the enhancement means are located between the peaks and troughs on the wavy surface, but are not located in the smooth areas between the aligned holes.

24. The heat exchanger surface of claim 23 wherein the enhancement means includes louvers.

25. The heat exchanger surface of claim 24 wherein each louver has an upwardly directed element and a downwardly directed element.

26. The heat exchanger surface of claim 25 where each louver is paired with a second louver formed in its mirror image.

27. The heat exchanger surface of claim 26 wherein the louver elements of each louver closest to the nearest peak or trough extend from the wavy surface in a direction opposite the nearest peak or trough.

28. The heat exchanger surface of claim 27 wherein the amount of protrusion of each louver from the wavy surface is in the range of zero to four times the thickness of the wavy surface.

29. The heat exchanger surface of claim 24 wherein the amount of protrusion of each louver from the wavy surface is not greater than four times the thickness of the surface.

30. The heat exchanger surface of claim 29 wherein the amount of protrusion of each louver from the wavy surface is approximately 3.6 times the thickness of the surface.

31. The heat exchanger surface of claim 24 wherein the amount of protrusion of each louver from the wavy surface is not greater than three times the thickness of the surface.

32. The heat exchanger surface of claim 23 wherein the louvers remain attached to the wavy surface on two sides of the louver.

* * * * *

UNITED STATES PATENT AND TRADEMARK OFFICE

CERTIFICATE OF CORRECTION

PATENT NO. : 5,056,594

DATED : October 15, 1991

INVENTOR(S) : Michael L. Kraay

It is certified that error appears in the above-identified patent and that said Letters Patent is hereby corrected as shown below:

Claim 8, Column 5, Line 15, "enhancement" should be --protrusion--.

Claim 14, Column 5, Line 52, "the first" should be --a first--.

Claim 23, Column 6, Line 40, "late fin" should be --plate fin--.

Claim 23, Column 6, Line 49, "locate din" should be --located in--.

Signed and Sealed this

Ninth Day of February, 1993

*Attest:*

STEPHEN G. KUNIN

*Attesting Officer*

*Acting Commissioner of Patents and Trademarks*